US008256520B2

(12) United States Patent
Lucas et al.

(10) Patent No.: US 8,256,520 B2
(45) Date of Patent: Sep. 4, 2012

(54) DRILL SHIP

(75) Inventors: Alan Randall Lucas, Spring, TX (US); Marcus Sherwin McCoo, Katy, TX (US)

(73) Assignee: National Oilwell Varco L.P., Houston, TX (US)

( * ) Notice: Subject to any disclaimer, the term of this patent is extended or adjusted under 35 U.S.C. 154(b) by 677 days.

(21) Appl. No.: 12/321,010

(22) Filed: Jan. 14, 2009

(65) Prior Publication Data

US 2010/0176079 A1 Jul. 15, 2010

(51) Int. Cl.
*E21B 7/12* (2006.01)
*B66C 23/52* (2006.01)

(52) U.S. Cl. ..... 166/352; 166/353; 166/355; 175/5; 212/307

(58) Field of Classification Search ..... 166/352, 166/353, 355; 175/5, 162, 163; 114/268, 114/269; 405/195.1, 203, 204, 223.1
See application file for complete search history.

(56) References Cited

U.S. PATENT DOCUMENTS

| | | | | |
|---|---|---|---|---|
| 2,804,949 | A | 9/1957 | Woolslayer et al. | |
| 2,929,610 | A | 3/1960 | Stratton | |
| 3,011,318 | A | 12/1961 | Ashton | |
| 3,340,938 | A | 9/1967 | Wilson | |
| 3,403,485 | A | 10/1968 | Cernosek | |
| 3,804,183 | A | 4/1974 | Duncan et al. | 175/5 |
| 3,851,770 | A * | 12/1974 | Jenkins et al. | 414/22.56 |
| 3,996,754 | A | 12/1976 | Lowery | 61/92 |
| 4,064,822 | A | 12/1977 | Thornburg | 114/230 |
| 4,134,237 | A | 1/1979 | Armstrong | 52/118 |
| 4,269,395 | A | 5/1981 | Newman et al. | 254/386 |
| 4,590,720 | A | 5/1986 | Reed | 52/121 |
| 4,688,764 | A * | 8/1987 | Nayler et al. | 254/277 |
| 4,757,592 | A | 7/1988 | Reed | 29/429 |
| 4,837,992 | A * | 6/1989 | Hashimoto | 52/118 |
| 4,932,175 | A | 6/1990 | Donnally | 52/118 |
| 5,066,059 | A | 11/1991 | Egbert et al. | 294/82.16 |
| 5,216,867 | A | 6/1993 | Westerval, Jr. et al. | 52/745.01 |
| 5,342,020 | A | 8/1994 | Stone | 254/269 |
| 5,423,158 | A | 6/1995 | Vora | 52/745.17 |
| 5,450,695 | A * | 9/1995 | Desai | 52/118 |
| 6,047,781 | A | 4/2000 | Scott et al. | 175/5 |
| 6,056,071 | A * | 5/2000 | Scott et al. | 175/5 |
| 6,068,069 | A | 5/2000 | Scott et al. | 175/5 |
| 6,085,851 | A | 7/2000 | Scott et al. | 175/7 |
| 6,343,662 | B2 * | 2/2002 | Byrt et al. | 173/4 |
| 6,443,240 | B1 | 9/2002 | Scott | 175/7 |
| 6,523,319 | B2 | 2/2003 | Bockhorn et al. | 52/651.01 |
| 6,539,888 | B1 | 4/2003 | van der Poel | 114/265 |

(Continued)

OTHER PUBLICATIONS

Power Pipe Handling, BJ Hughes, 1 p., 1980.

(Continued)

*Primary Examiner* — Thomas Beach
*Assistant Examiner* — James Sayre
(74) *Attorney, Agent, or Firm* — Williams, Morgan & Amerson, P.C.

(57) ABSTRACT

Floating systems for well operations are disclosed with a height-adjustable crown assembly movably connected to a derrick; in one aspect, movable within the derrick by movement apparatus; and, in one aspect, movable with a motion compensator. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

22 Claims, 15 Drawing Sheets

U.S. PATENT DOCUMENTS

| | | | | |
|---|---|---|---|---|
| 6,682,265 | B1 | 1/2004 | Kudsk | 405/209 |
| 6,860,337 | B1 | 3/2005 | Orr et al. | 173/28 |
| 7,308,953 | B2 | 12/2007 | Barnes | 175/203 |
| 7,461,831 | B2 * | 12/2008 | Mosley | 254/277 |
| 7,828,086 | B2 * | 11/2010 | Lesko | 175/203 |
| 2008/0000685 | A1 | 1/2008 | Humphreys | 175/5 |
| 2008/0149395 | A1 * | 6/2008 | Fossbakken et al. | 175/162 |

OTHER PUBLICATIONS

Offshore Drilling and Production Equipment, Tanaka et al, EOLSS, 3 pp., 2000.

Looking into the future with Steve Newman Transocean, Drilling Contractor, pp. 42, 44, 46, Jan./Feb. 2007.

New Drillship designs offer improved motion characteristics, Offshore, 3 pp., Jul. 1994.

Crown Compensator, IFP, 4 pp., 1992.

Architectural requirements for a fifth generation drillship, Garcia, 9 pp., Offshore, Apr. 1998.

Drilling Ships, IADC, 2 pp., Apr. 29, 2004.

Crown Mounted Drill String Compensator, Maritime Hydraulics, 6 pp., 2005.

Crown Compensator, National Oilwell, 6 pp., 2006.

Drillship technologies introduce simultaneous Operations, Online Research Center, 8 pp., Jan. 1, 2000.

* cited by examiner

FIG. 1
(PRIOR ART)
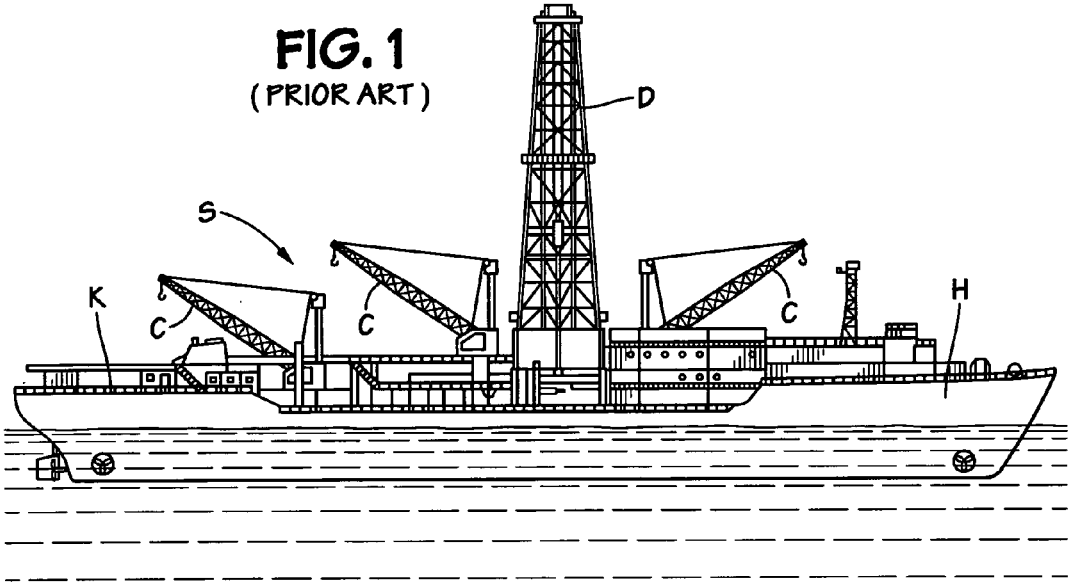
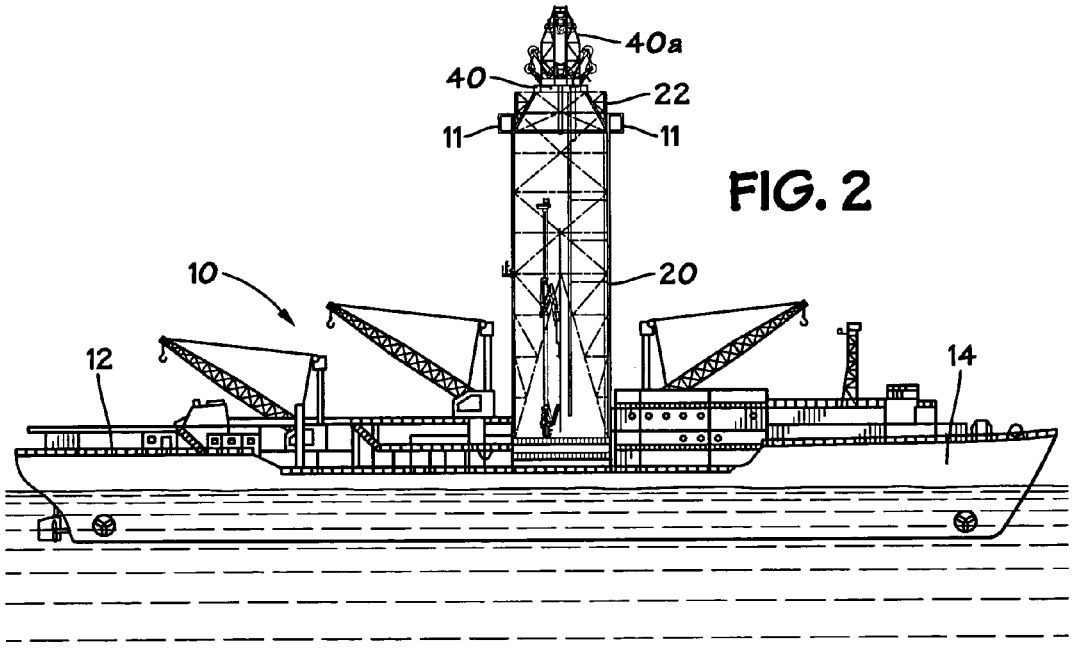
FIG. 2

221
222
230
240
240
200
210
202
201
W1
W2

DRILL SHIP

BACKGROUND OF THE INVENTION

1. Field of the Invention

This invention is directed to floating systems, rigs and vessels used in wellbore operations; to floating systems, rigs, drill ships and vessels with a height-adjustable derrick; to methods for selectively adjusting a floating system's center of gravity; and to methods for adjusting derrick height by changing the position of part of a derrick, e.g. a crown block assembly and associated structure.

2. Description of Related Art

Well drilling has been conducted in areas where a substantial body of water overlies an oil field. In many cases a variety of fixed drill platforms mounted on legs resting on or driven into a sea floor or lake floor are used. These, however, are typically used only in relatively shallow depths of water, often not greater than about 300 feet, which is a realistic depth limit for many practical commercial operations.

Often deep water drilling is accomplished using specifically designed and constructed rigs, vessels and drill ships. Deep water and exploratory drilling has been accomplished using surface floating rigs, drilling ships or vessels which are either towed or self-propelled to a drilling site and are self-contained in that the drilling rig, auxiliary equipment, and crew's quarters form an integral part of the vessel or ship. These floating drilling systems (rigs, vessels, drill ships) are positioned over a drilling site. Certain typical rigs, vessels and drill ships have, in addition to all of the equipment normally found on a large ocean ship, a drilling platform and derrick located on the deck. In addition, such rigs, vessels and drill ships contain a hole (or "moonpool"), extending through the ship down through the hull, which allows for a drill string to extend through the ship, down into the water.

Drill ships are often used for deepwater drilling in remote locations with moderate weather environments because of their mobility and large load carrying capability. Drill ships can move from one location to the next rapidly and under their own power. On the open seas, size and height are generally not a consideration for drill ship movement; but, in certain specific circumstances, size and height limit a drill ship's mobility and can significantly increase the expense of movement from one site to another. For example, moving a drill ship through the Panama Canal can require the partial disassembly of a ship's derrick (and then its reassembly after passing through the canal) at a cost of several million dollars.

Various prior art drill ships are relatively large. For example Transocean's Discoverer Enterprise, an ultra-deepwater drill ship, is 835 feet in length and 125 feet wide and can drill a well more than 6.5 miles beneath its drill floor. Drill ships can be, in total, 20 to 30 stories high with an upright derrick over 400 feet high. The JOIDES Resolution drill ship is 470 feet long with a 202 foot high derrick.

In the past a variety of drill ship tragedies have involved the capsizing of a drill ship, particularly in stormy seas. One factor contributing to the instability of a drill ship is the height of the ship's center of gravity which is related to the height and the weight of a derrick projecting up from a ship's deck. The weight of pipe and equipment in and on the derrick can also affect the location of the ship's center of gravity. In typical drill ships, although pipe can be moved from a vertical to a horizontal position, the derrick itself is a permanent upright structure whose height is not adjustable in adverse conditions.

There are a variety of known rigs, vessels, and drill ships used in drilling and various wellbore operations; for example, and not by way of limitation, those disclosed in U.S. Pat. Nos. 2,929,610; 3,011,318; 4,064,822; 4,269,543; 4,657,438; 4,885,698; 5,139,366; 5,450,695; 5,622,452; 5,833,396; 5,906,457; 5,975,805; 5,975,806; 6,056,071; 6,047,781; 6,076,996; 6,085,851; 6,068,069; 6,443,240; 6,539,888; 6,682,265; 7,011,471; 7,163,355; 7,186,061; and U.S. Application Pub. No. 2008/0000685, and in the references cited in these patents—all these patents incorporated fully herein for all purposes.

There are a variety of known systems with a portable and/or erectable derrick or mast; for example U.S. Pat. Nos. 7,308,953; 6,860,337; 6,523,319; 5,450,695; 5,423,158; 5,342,020; 5,216,867; 4,932,175; 4,837,992; 4,757,592; 4,590,720; 4,269,395; 4,134,237; 3,996,754; 3,403,485; 3,340,938; and 2,804,949,

BRIEF SUMMARY OF THE INVENTION

The present invention, in certain aspects, provides a floating system, e.g. a vessel, a drill ship, a rig, (e.g., but not limited to, jack-up rigs and semi-submersible rigs) with a height-adjustable derrick; and, in one particular aspect, a rig, vessel or a drill ship with a derrick having a crown assembly (and, in some aspects, associated structure, e.g. but not limited to support structure and/or motion compensator apparatus) whose position is selectively adjustable. In certain aspects, adjusting the position of the crown assembly provides adjustment of the ships's center of gravity which can be beneficial during various operations and during adverse sea and weather conditions. In one aspect, the crown assembly includes a motion compensation system.

The present invention, in certain aspects, provides systems and methods for effectively reducing the overall height of a derrick on a floating well operations system by lowering a crown assembly (and, in some aspects, associated items). This is advantageous when moving the system through certain waterways (e.g., under bridges or through a strait or a canal, e.g. the Panama Canal) which present various height-restricted passages. In one aspect, such a system has a hull; a deck on the hull; a derrick on the deck, the derrick having a top and a top portion; a crown assembly (optionally with a motion compensator) on the derrick; and the crown assembly movably mounted to the derrick for movement with respect to the top portion of the derrick to reduce overall height of the derrick.

The present invention discloses, in certain aspects, a floating well operations system with a derrick having one or more apparatuses for pivotably connecting derrick equipment to the derrick so that the equipment is selectively movable away from the path of a crown assembly being lowered in the derrick. In one particular aspect, a top drive system is included with a guide rail structure on which a top drive moves up and down in the derrick. According to the present invention, part of the guide rail of the derrick is pivotably connected to the derrick so that it can be moved aside to permit the crown assembly to be moved down into the derrick.

Accordingly, the present invention includes features and advantages which are believed to enable it to advance floating well operations systems technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, nonobvious floating systems for well operations, including drilling operations, including rigs, vessels and drill ships and new, useful, unique, efficient, nonobvious floating systems with a height-adjustable derrick;

Such systems with a derrick and with a crown assembly movably mounted on the derrick for selective height adjustment; and Such systems with an adjustable center of gravity.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 1 is a side view of a prior art drill ship.

FIG. 2 is a schematic side view of a drill ship according to the present invention.

Figure 3A:
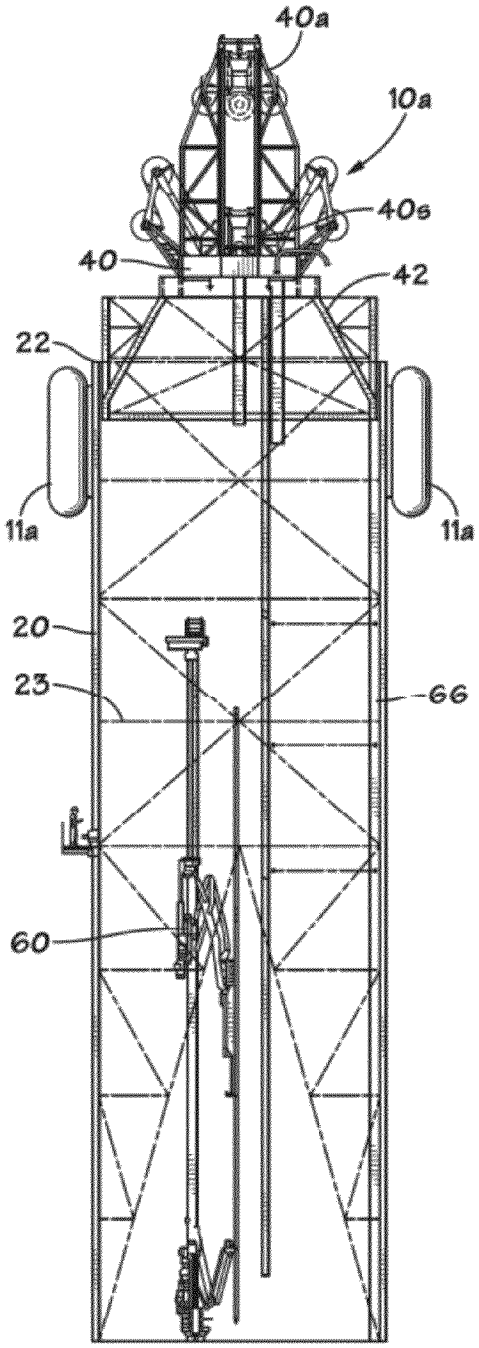
FIG. 3A is a front view of part of the ship of FIG. 2, including, among other things, a crown block assembly.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1 shows a typical prior art drill ship S with a deck K on a hull H. One or more cranes C are on the deck K. An upright derrick D is mounted on the deck K.

FIG. 2 shows a floating system 10, e.g., in one aspect, a drill ship, according to the present invention with a deck 12 on a hull 14. A derrick 20 according to the present invention is mounted on the deck 12. The derrick 20 has a crown assembly 40 and an associated (optional) motion compensator 40*a* releasably and movably connected to a top part 22 of the derrick 20. Movement apparatus 11 (shown schematically) selectively moves the crown assembly 40 and the motion compensator 40*a* down to reduce the overall weight of the derrick 20. The movement apparatus 11 may be any apparatus disclosed herein.

As shown in FIG. 3A, in an embodiment 10*a* according to the present invention the derrick 20 has a plurality of cross-members and braces 23. A pipe handling system 60 connected to the derrick moves pipe, e.g. drill pipe. A guide rail structure 66 connected to the derrick 20 guides a top drive system TDS (shown schematically, FIG. 3B) within the derrick. A support 9 is pivotably secured to the derrick 20 with pivoting arms 9*a* so that the top drive TDS is movably downwardly out of the way of the crown assembly 40.

A crown assembly 40 has crown sheave 40*s* and a base 42 which is movable by movement apparatus 11*a* (shown schematically) within the derrick 20.

Figure 3B:
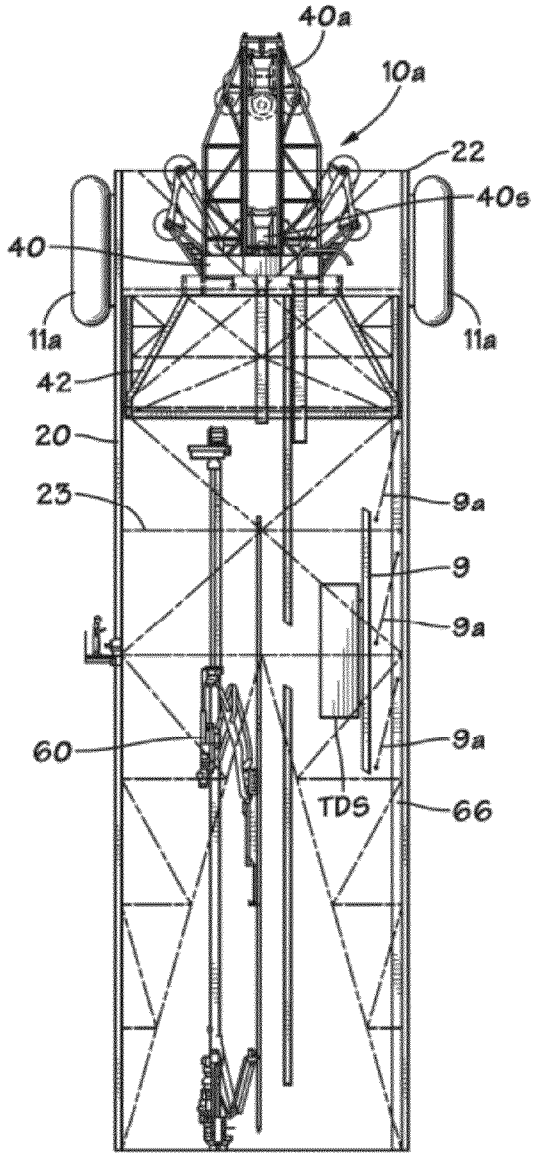
FIG. 3B is a front view of the part of the ship of FIG. 3A showing the crown block assembly lowered.

Initially, e.g. as shown in FIG. 3A, the crown block assembly 40 with the compensator 40*a* projects beyond the top part 22 of the derrick 20. As shown in FIG. 3B, the crown block assembly 40 and compensator 40*a* have been lowered to a lower position within the derrick 20.

In one particular aspect, the derrick 20 (including the crown block assembly and compensator) is 201 feet 8 and 11/16 inches in height as shown in FIG. 3A; and, in the crown-block-assembly-lowered position of FIG. 3B, the overall height is 171 feet 8 and 11/16 inches—a difference of 30 feet. In one such aspect, the crown block assembly 40 etc. weighs about 150,000 pounds so that lowering the crown block assembly 40 etc. as shown results in a significant lowering of the center of gravity of the drill ship 10.

Figure 4A:
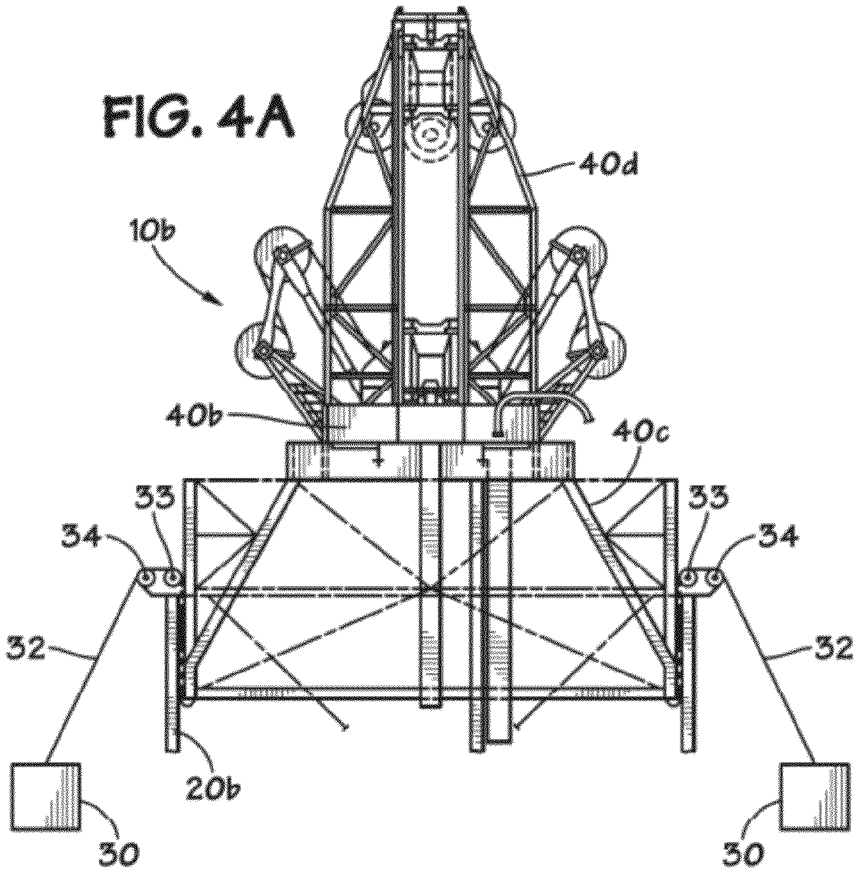
FIG. 4A is a front view of a derrick (shown partially) with a crown assembly according to the present invention.
Figure 4B:
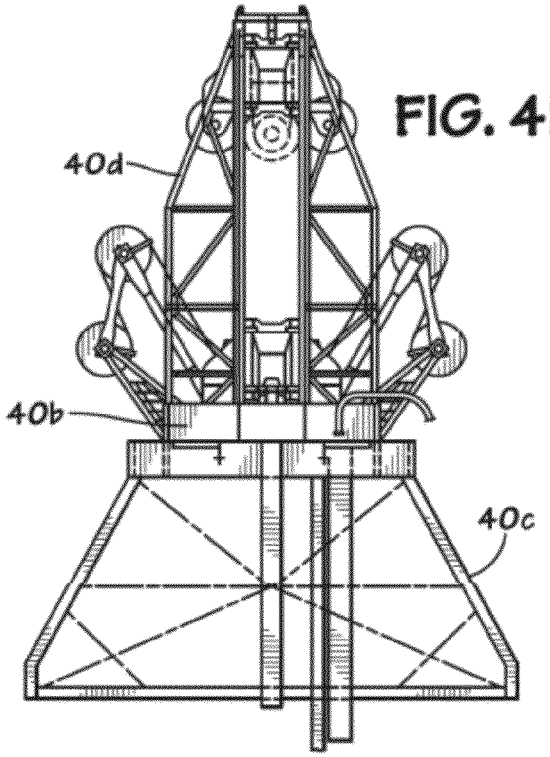
FIG. 4B is a front view of the crown assembly of the derrick of FIG. 4A.

FIG. 4A shows a system 10*b* according to the present invention (like the system 10) in which a crown assembly 40*b* with a base 40*c* (see FIG. 4B) is movably mounted at the top of a derrick 20*b* of a drill ship with a motion compensator 40*d*. The crown assembly 40*b* with the compensator is lowered in the derrick 20*b* by a powered apparatus 30 with line 32 connected to the crown assembly 40*b* and passing over sheaves 33, 34. The apparatus 30 reels in and pays out the line 32 to raise and lower the crown assembly 40*b* and the compensator. Optionally, two apparatuses 30 and lines 32 are used.

Figure 5A:
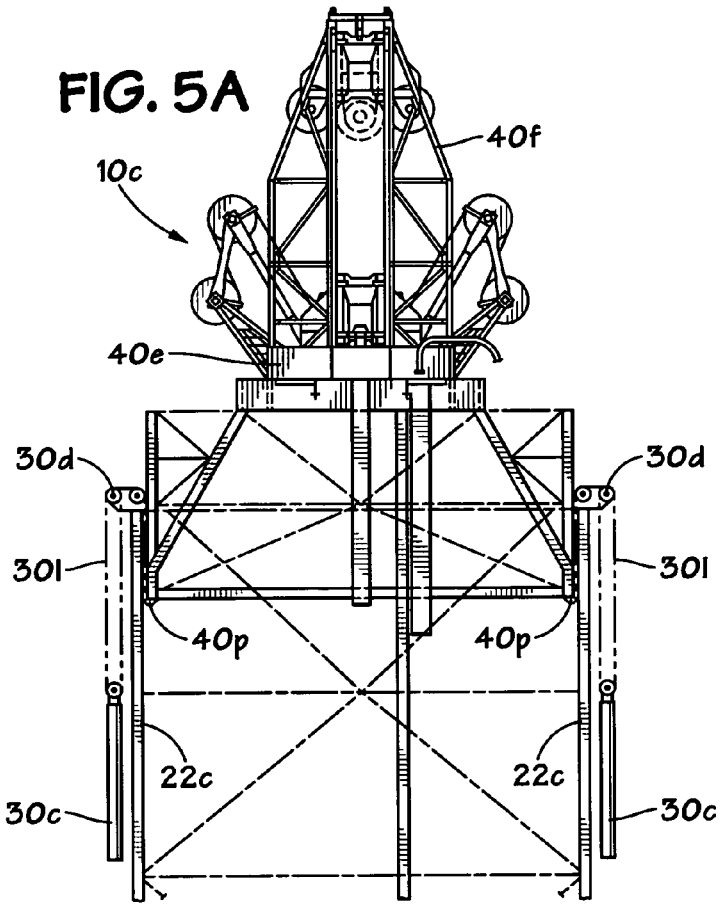
FIG. 5A is a front view of a derrick according to the present invention and a crown assembly according to the present invention.
Figure 5B:
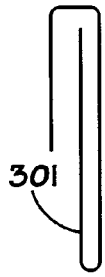
FIG. 5B shows a line of the derrick of FIG. 5A.
Figure 5C:
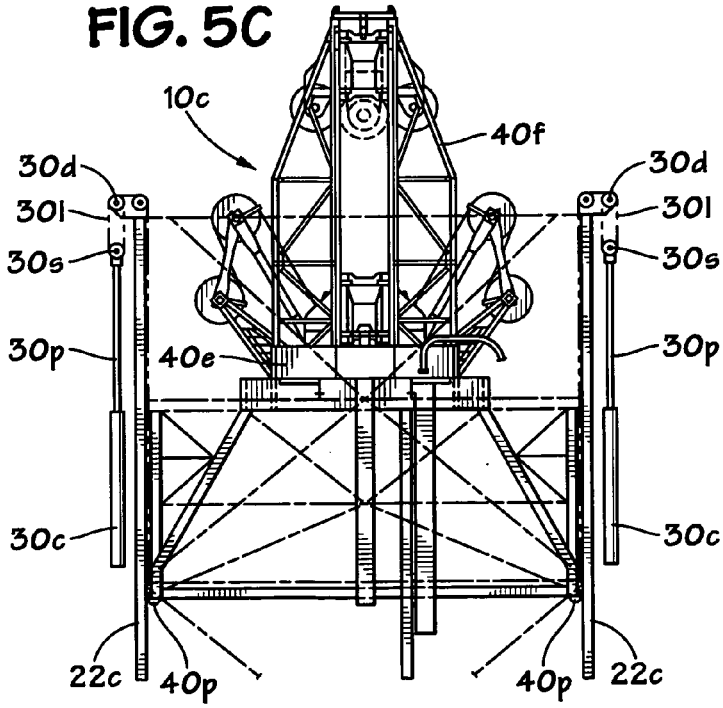
FIG. 5C is a front view of the derrick and crown assembly of FIG. 5A with the crown assembly lowered.
Figure 5D:
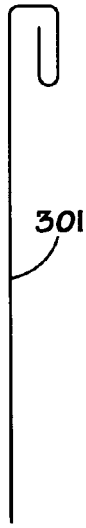
FIG. 5D shows the line of FIG. 5B in the position shown in FIG. 5C.

FIGS. 5A and 5C show a system 10*c* according to the present invention (like the system 10) with a crown assembly 40*e* and motion compensator 40*f* movable with respect to a top 22*c* of a derrick of a drill ship. Apparatuses 30*c* raise and lower the crown assembly 40*e*.

As shown in FIG. 5A, the crown assembly 40*e* is at its highest position with respect to the top 22*c* of the derrick. Pistons 30*p* of the apparatuses 30*c* are retracted and lines 30*l* extend around piston sheaves 30*s* and derrick sheaves 30*d* and are secured to the crown assembly at points 40*p*.

As shown in FIG. 5C, the pistons 30*p* have been extended resulting in lowering of the crown assembly 40*e* and the compensator with respect to the top 22*c* of the derrick.

Figures 6A, 6B, 6C:
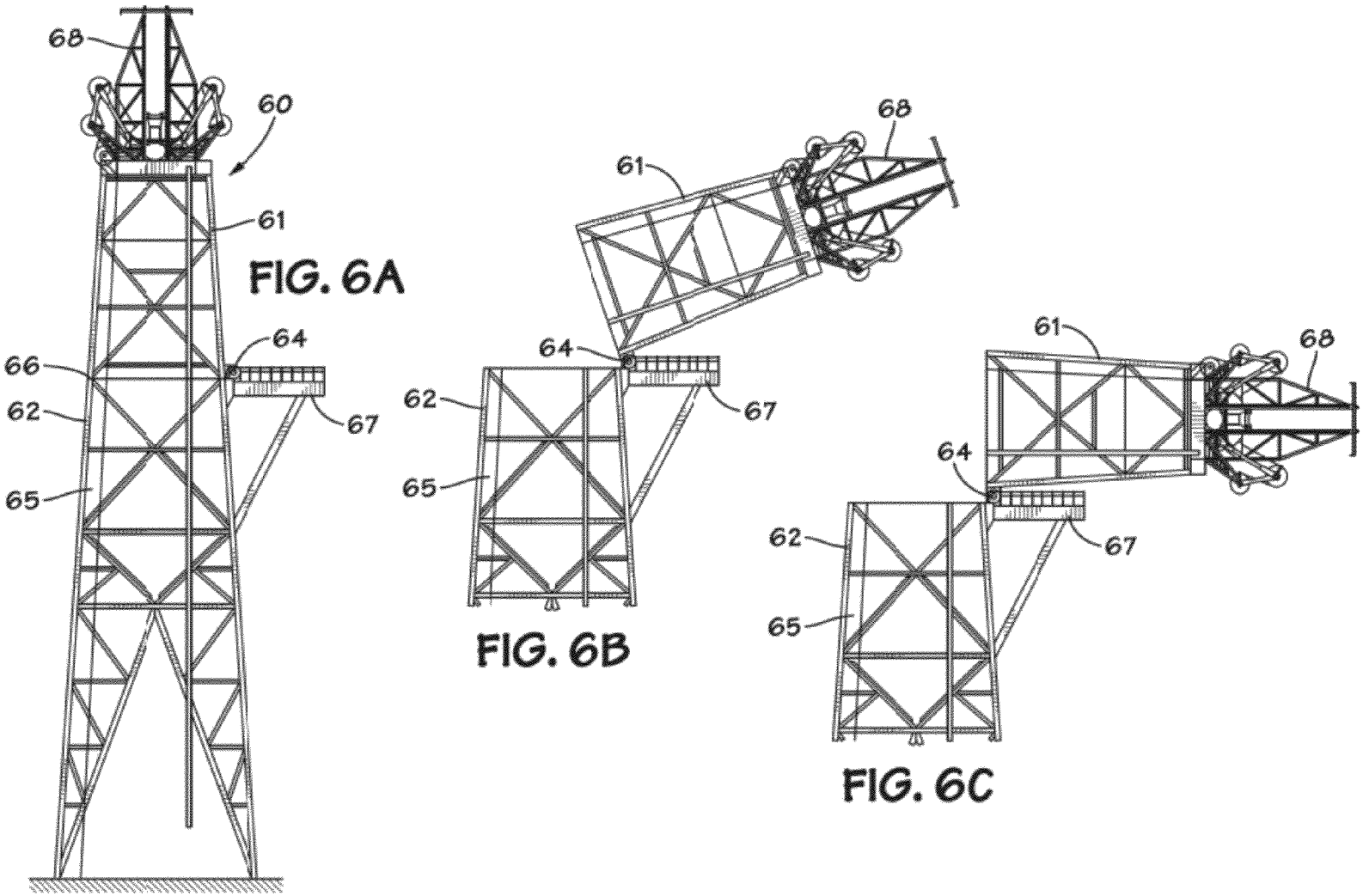
FIG. 6A is a front view of a derrick according to the present invention.
FIG. 6B is a front view of the derrick of FIG. 6A with a top part tilted.
FIG. 6C is a front view of the derrick of FIG. 6A with a top part tilted.

FIGS. 6A-6C illustrate a system 60 according to the present invention which includes a derrick 62 on a drill ship (not shown). A top part 61 of the derrick 62 is pivotably mounted with pivot apparatus 64 to a lower part 65 of the derrick 62. The top part 65 includes a crown assembly/compensator combination 68.

As shown in FIG. 6B, a connection 66 has been released and the top part 61 has begun to tilt toward a support 67. As shown in FIG. 6C the top part 61 (with the combination 68) has been tilted approximately ninety degrees and rests on the support 67. This effectively reduces the overall height of the derrick 62 and, therefore, of the drill ship on which the derrick 62 is mounted; and also lowers the center of gravity of the drill ship.

Figure 7:
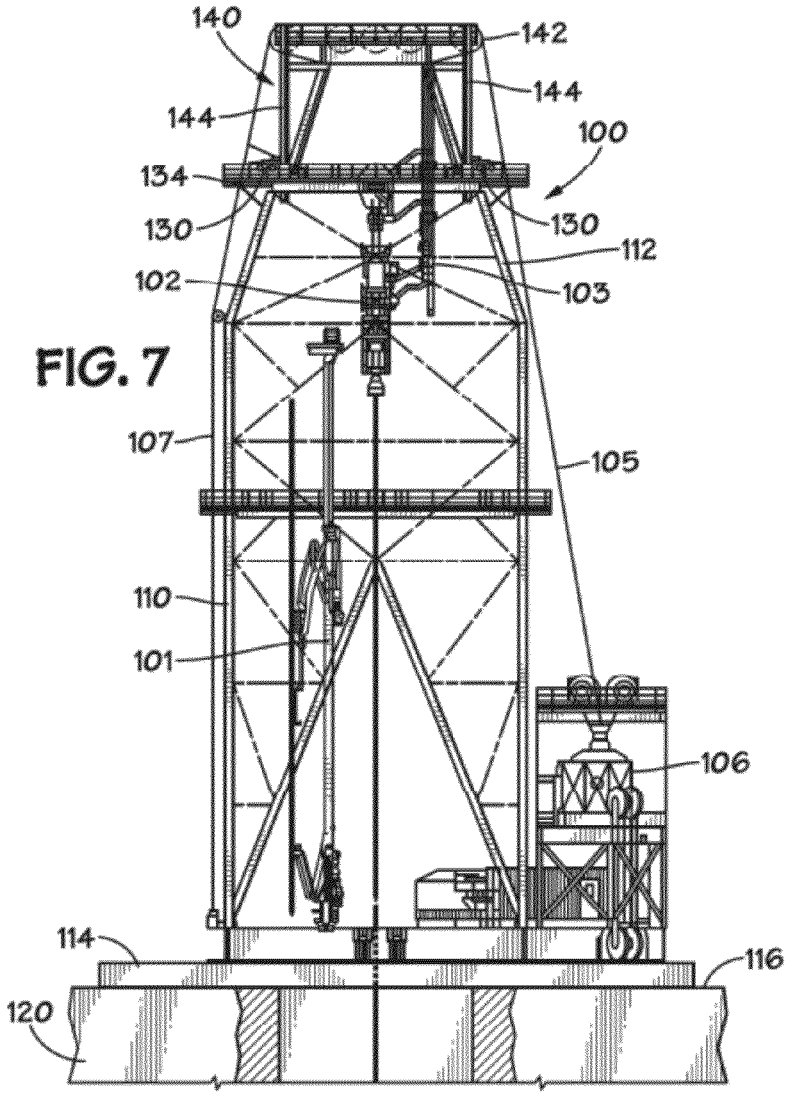
FIG. 7 is a front view of a derrick according to the present invention.

FIG. 7 shows a system 100 according to the present invention which has a crown assembly 140 at the top 112 of a derrick 110. The derrick 110 is on a drill floor 114 on a main deck 116 of a drill ship 120 (shown partially). A racker 101 handles pipe in the derrick 110 and a top drive 102 on a carriage 103 is movable within the derrick 110. A drawworks 106 has a fastline 105 which passes over crown sheaves 142. A deadline 107 is on the other side of the derrick 110.

Jacking systems 130 operate on toothed pillars 144 (see also FIG. 7A) to lower and raise the crown assembly 140. There are four pillars 144 and four jacking systems 130 (two shown, FIG. 7). The jacking system 130 are supported by a platform 134.

Figure 7A:
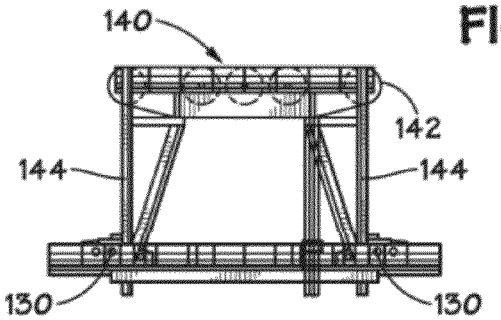
FIG. 7A is a front view of the crown assembly of the derrick of FIG. 7.
Figure 7B:
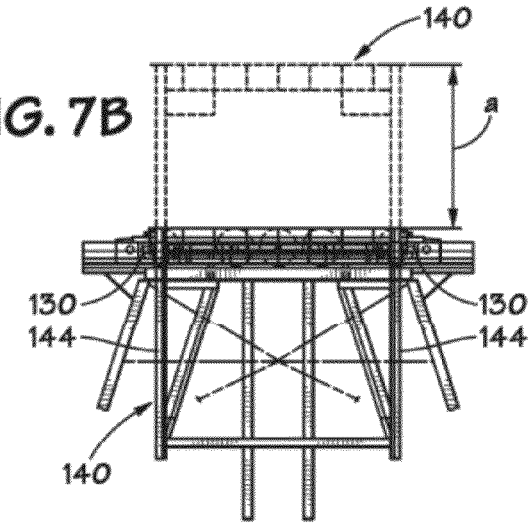
FIG. 7B is an illustration of a lowered position of the crown assembly of the derrick of FIG. 7.

FIG. 7A illustrates the reduced overall height of the derrick 110 when the crown assembly 140 is lowered. The raised position (as in FIG. 7) of the crown assembly 140 is shown in dotted lines in FIG. 7B. The crown assembly 140 has been lowered a distance a. In one particular aspect, this distance is about 23 feet 7 inches (or about 6.9 meters). With the top drive 103 lowered, the crown assembly 140 can be lowered within the derrick 110 without having to remove or relocate any other major pieces of equipment.

Figure 8A:
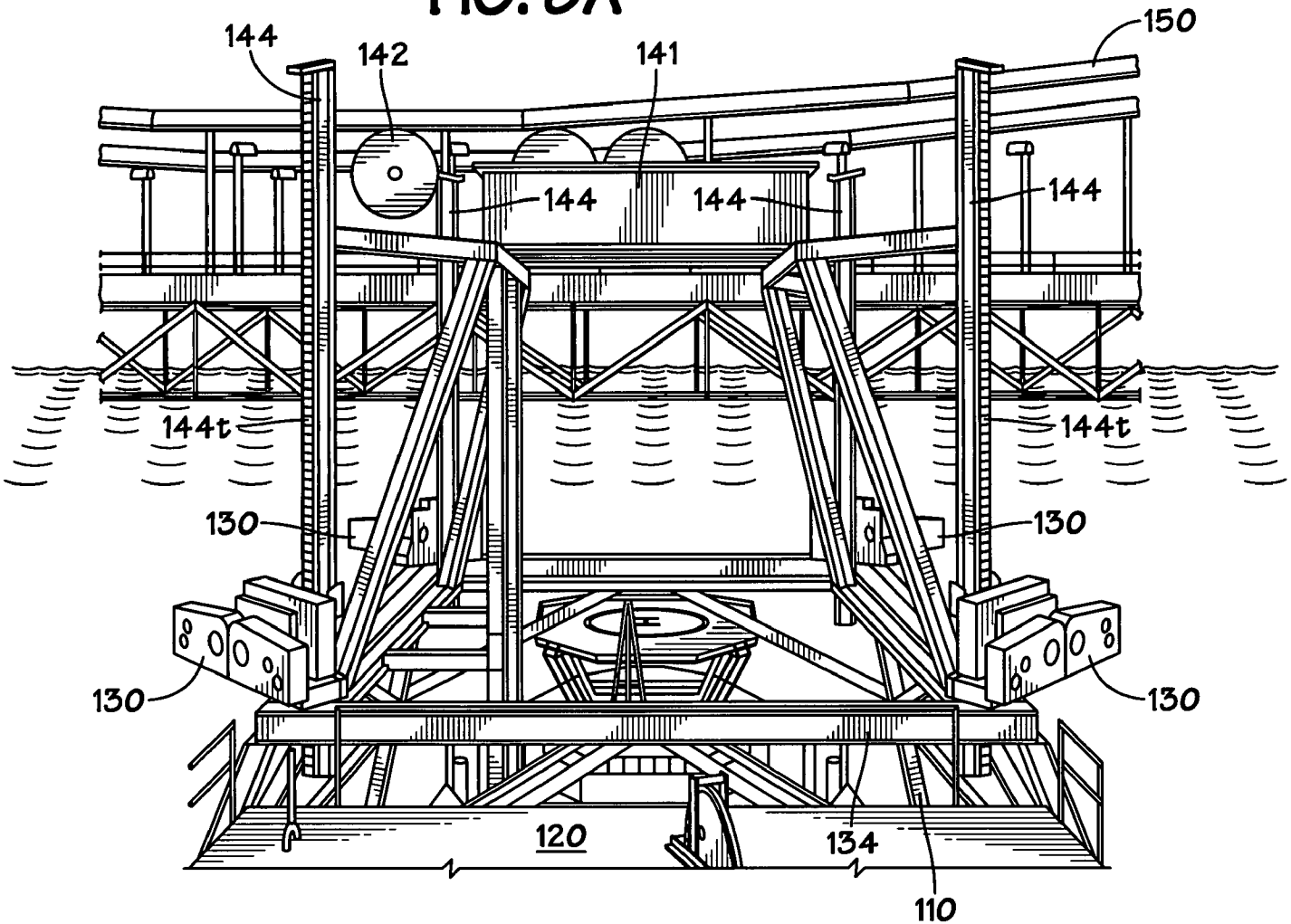
FIG. 8A is a rear view of a derrick according to the present invention on a drill ship according to the present invention approaching a bridge.
Figure 8B:
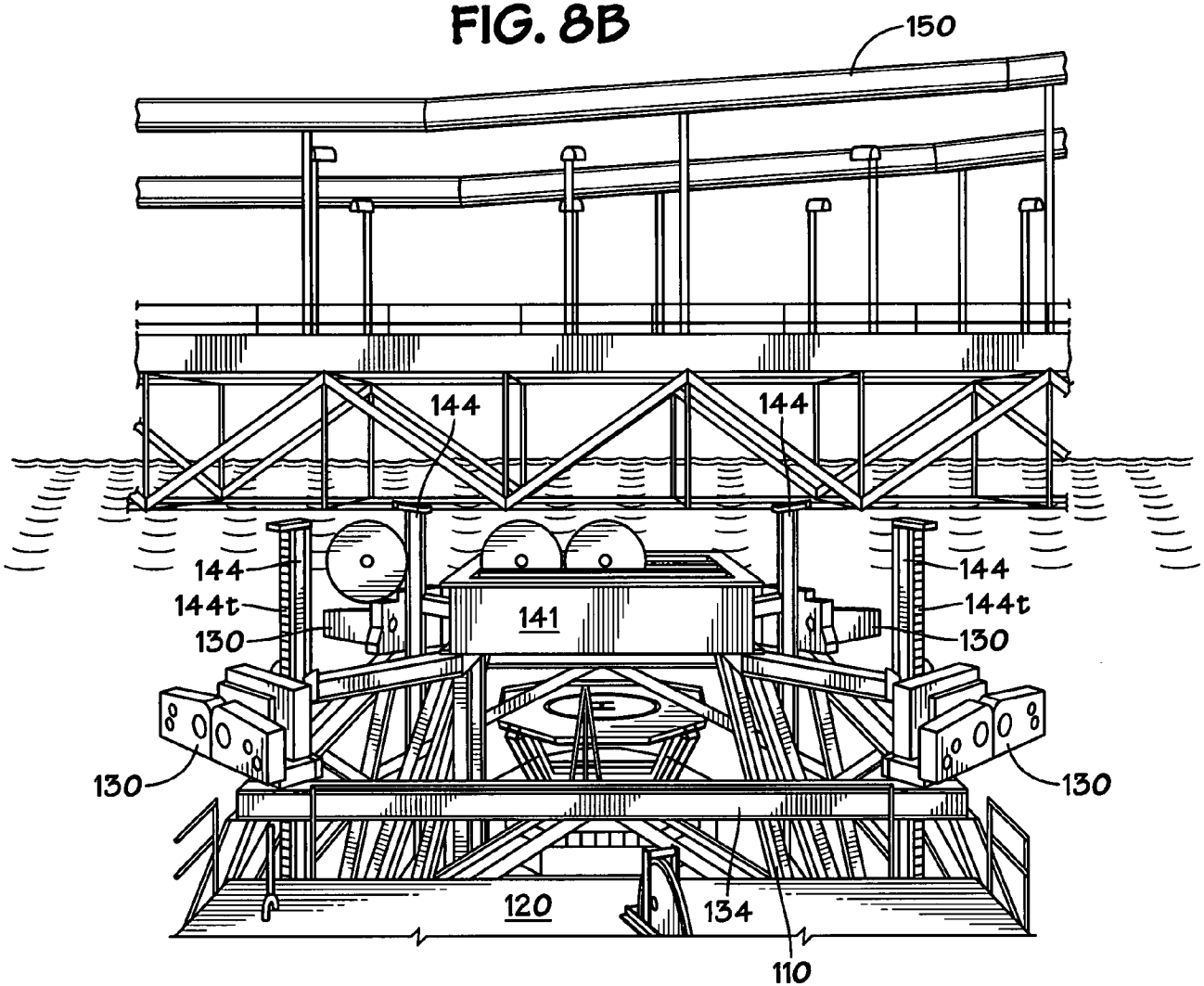
FIG. 8B is a side view showing the beginning of lowering of a crown assembly of the derrick of the drill ship of FIG. 8A.

FIGS. 8A-8F illustrate steps in the operation of a system 100 when the drill ship 120 approaches an obstacle (e.g. a bridge 150) under which it must pass. As shown in FIG. 8B, the jacking systems 130, working on teeth 144*t* of the pillars 144, has begun to lower a crown assembly 141 (like the crown assembly 140) down within the derrick 110, as the drill ship 120 continues to move toward the bridge 150.

Figure 8C:
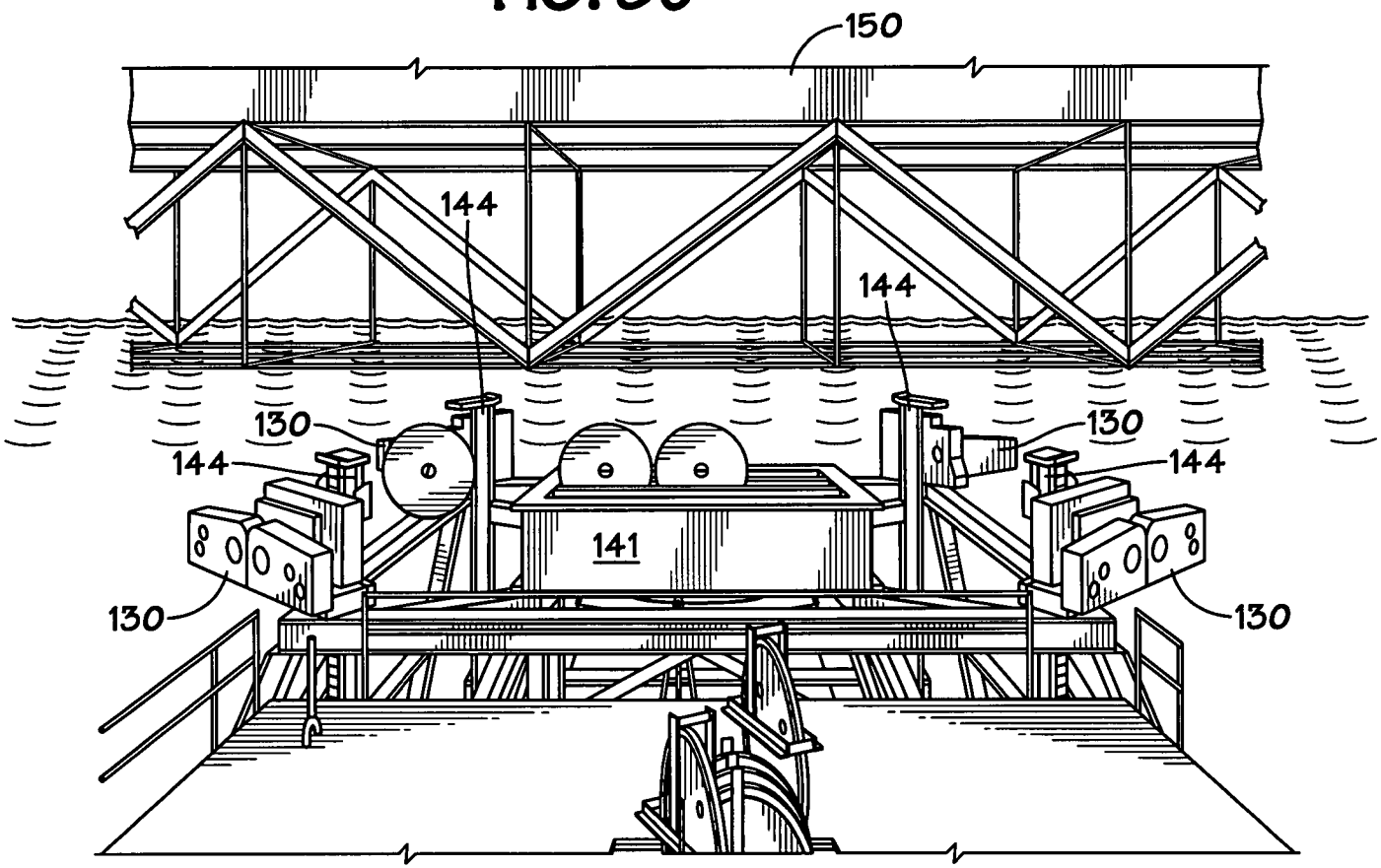
FIG. 8C is a side view further showing the beginning of lowering of a crown assembly of the derrick of the drill ship of FIG. 8A.

FIG. 8C illustrates the crown assembly 141 sufficiently lowered for the drill ship 120 to pass under the bridge 150.

Figure 8D:
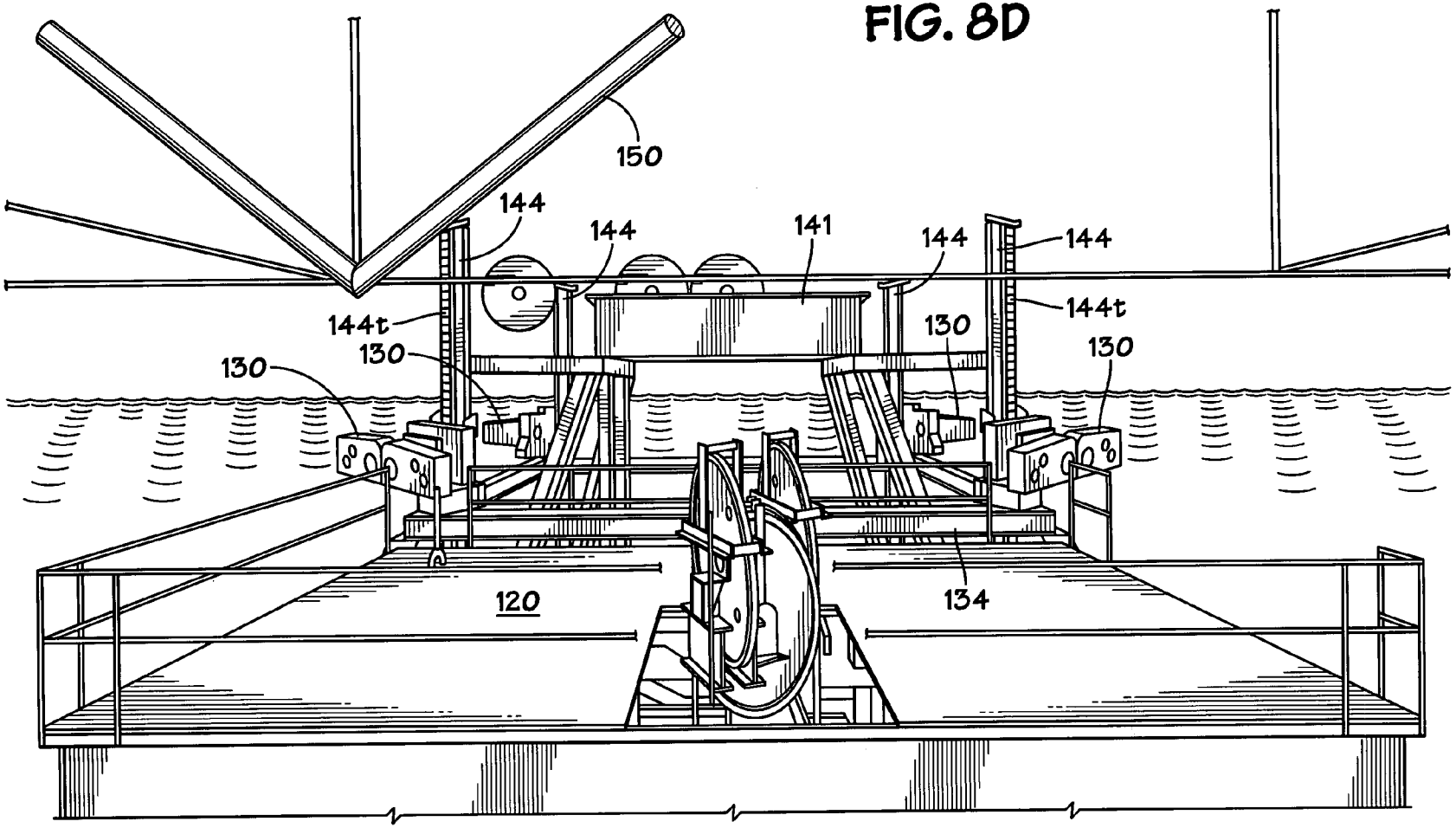
FIG. 8D shows the drill ship of FIG. 8A passing under the bridge and the beginning of raising of the crown assembly.
Figure 8E:
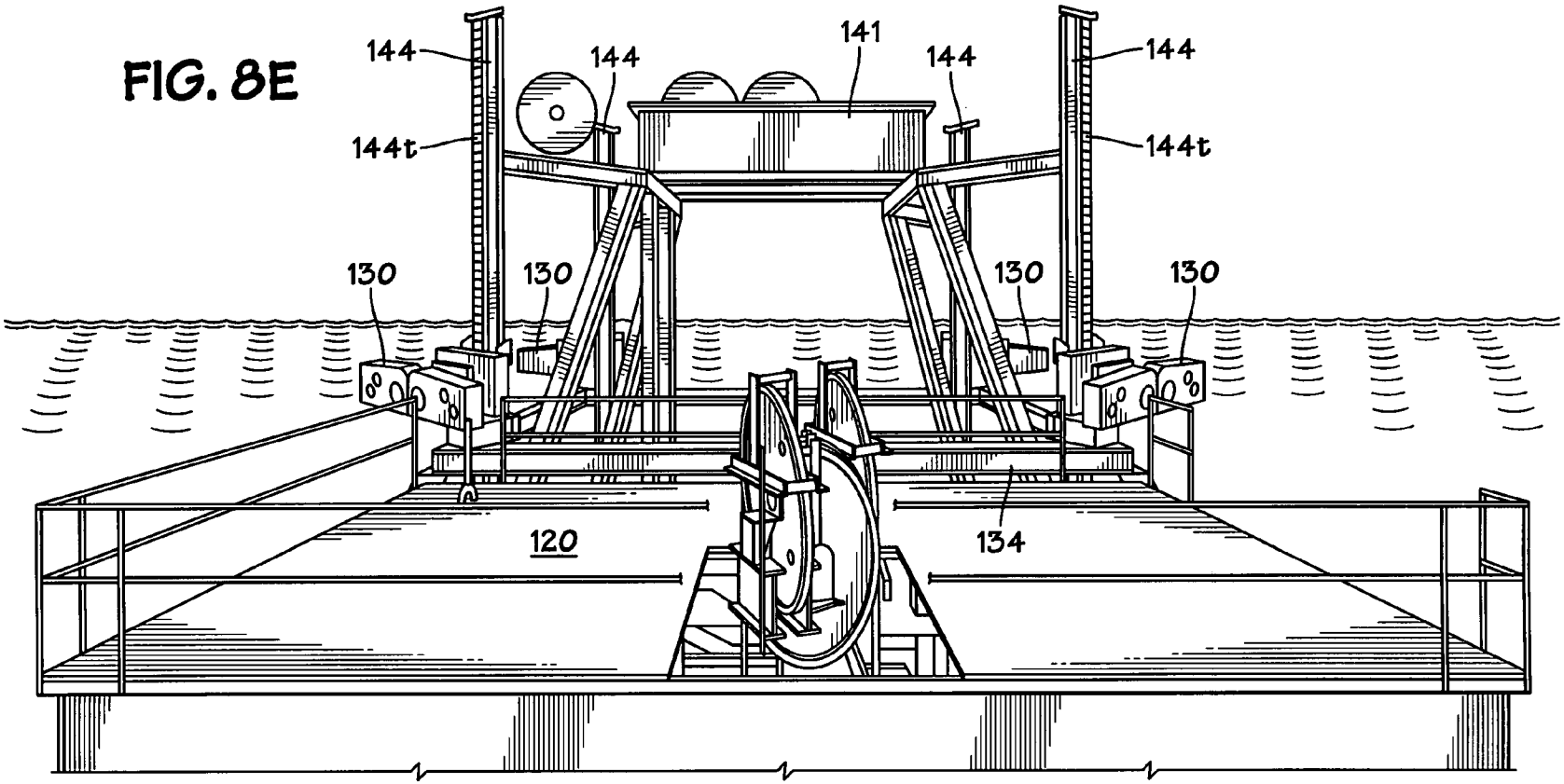
FIG. 8E shows further raising of the crown assembly.

As shown in FIG. 8D, part of the drill ship 120 is still passing under the bridge 150 and the derrick 110 has already passed under the bridge 150. The jacking systems 130 have begun to again raise the crown assembly 141 back to its position as in FIG. 8A before it was lowered. Continued raising of the crown assembly 141 is shown in FIG. 8E as the drill ship 120 continues to move.

Figure 8F:
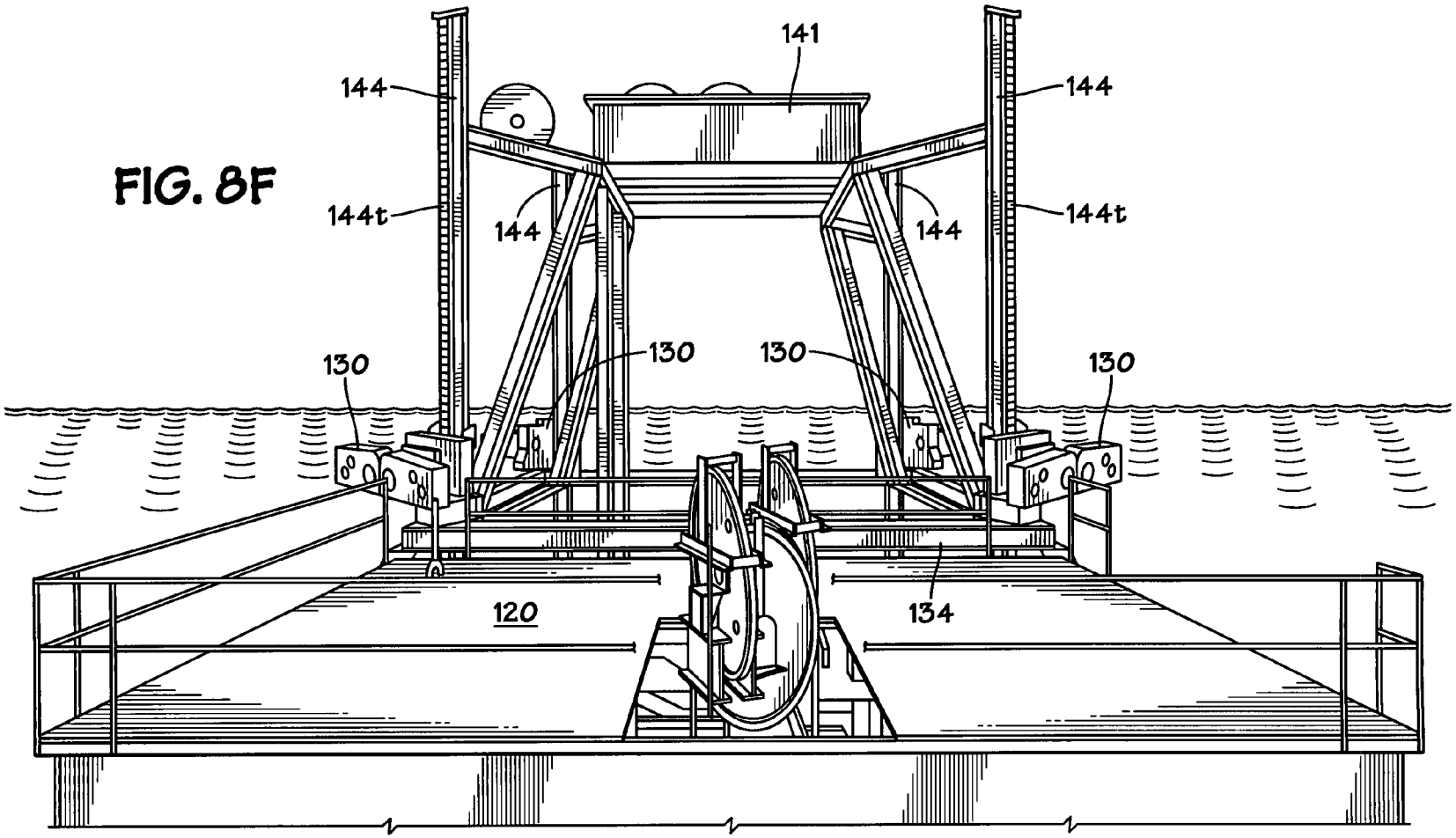
FIG. 8F shows the crown assembly raised.

As shown in FIG. 8F, the crown assembly 141 has been raised to its full upright position as in FIG. 8A.

Figure 9A:
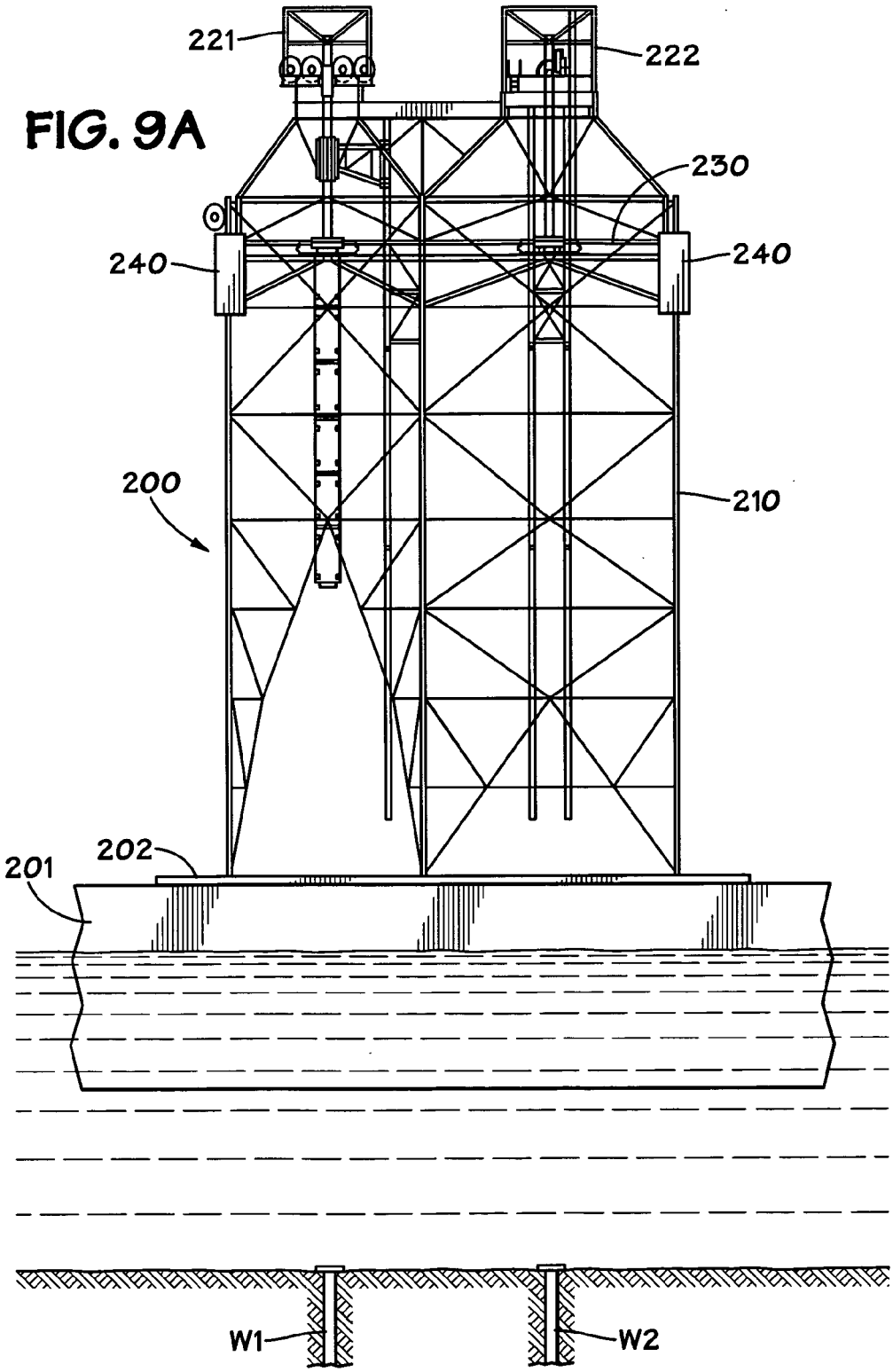
FIG. 9A is a front view of a derrick according to the present invention.
Figure 9B:
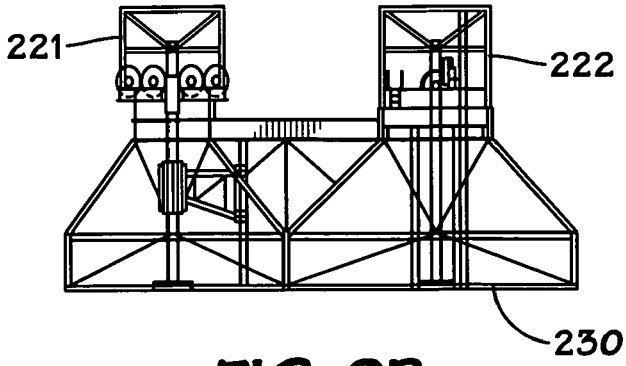
FIG. 9B is a front view of a crown assembly of the derrick of FIG. 9A.

FIG. 9A illustrates a dual activity rig 200 on a drill floor 202 of floating well operations system 201 which may be a floating rig, vessel or ship and which, as shown in one embodiment in FIG. 9A is a drill ship. The rig 200 is used with respect to two (or more) adjacent wellbore locations W1, W2 over which the drill ship 201 is positioned.

The rig 200 has a derrick 210 with two crown assemblies 221, 222 both of which are on a base 230. Movement apparatus 240 (which is shown schematically; may be any crown assembly movement apparatus disclosed herein) moves the base 230 and the crown assemblies 221, 222 down within the derrick 210.

Figure 9C:
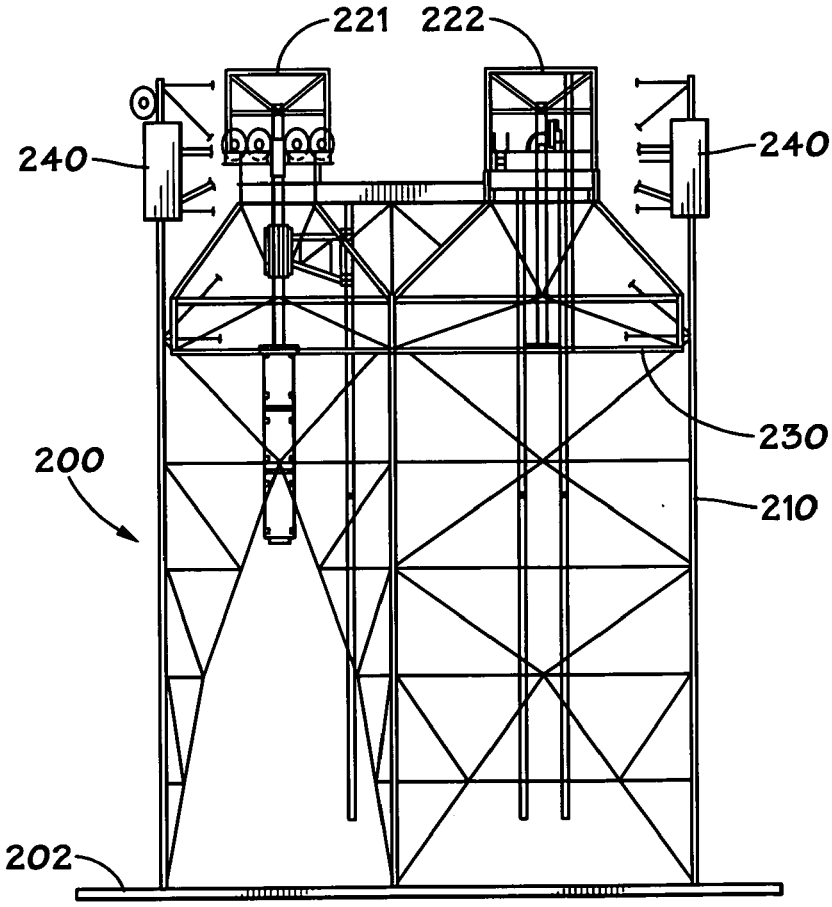
FIG. 9C is a front view of the derrick of FIG. 9A with the crown assembly lowered.

FIG. 9C illustrates a lowered position of the base 230 and crown assemblies 221, 222 within the derrick 210.

Figure 10A:
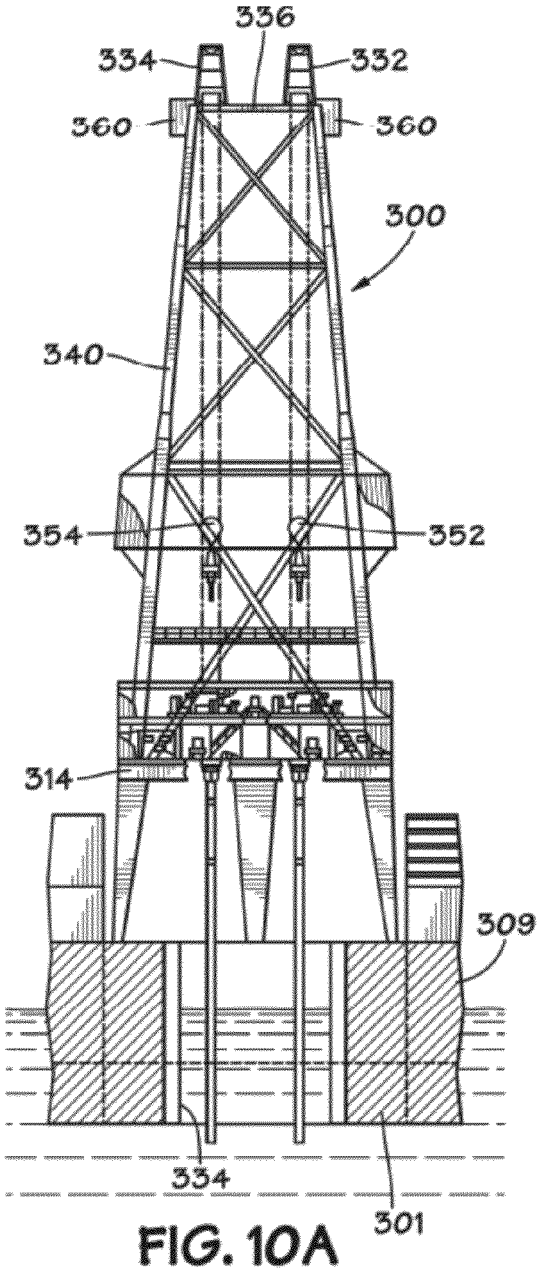
FIG. 10A is a front view of a drill ship according to the present invention with a derrick according to the present invention.
Figure 10B:
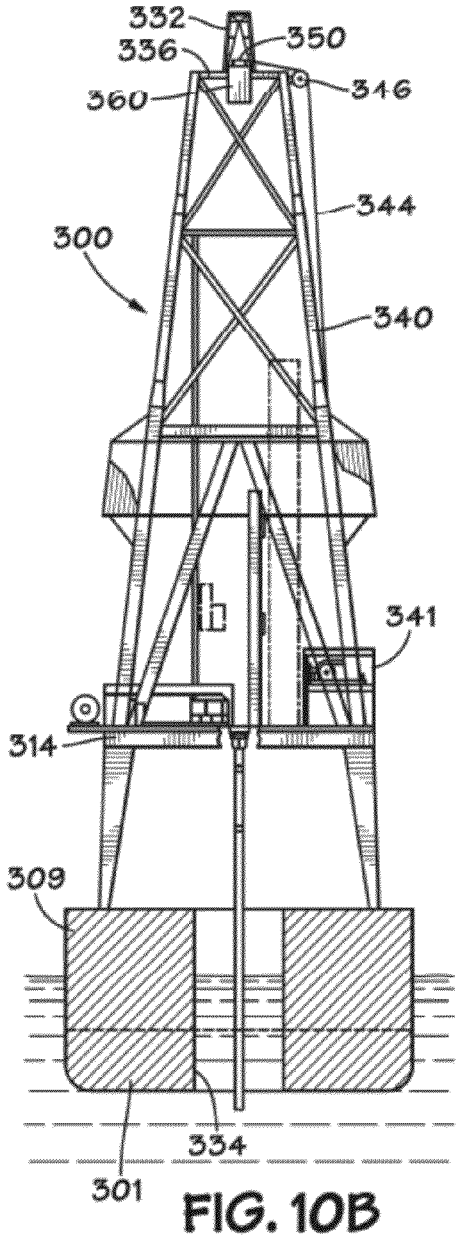
FIG. 10B is a side view of the derrick of FIG. 10A.
Figure 10C:
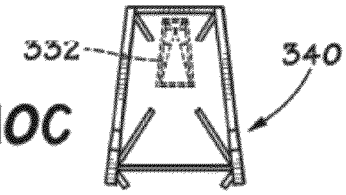
FIG. 10C is a partial view of the derrick of FIG. 10B showing the crown assemblies lowered.

FIGS. 10A-10C illustrate the application of the present invention to dual activity rigs, e.g. as disclosed in U.S. Pat. Nos. 6,068,069; 6,047,781; 6,085,851; 6,056,071; and 6,443,240—all incorporated fully herein for all purposes.

A system 300 includes a drill ship 301, a hull 309 and with a multi-activity derrick 340 which is located above a moonpool 334. The multi-activity derrick 340 drawworks 341 (two present; one shown in FIG. 10B) with appropriate cable 344 and sheaves 346, 350 traveling blocks 352, 354 etc. The derrick 340 is on a drill floor 314.

First and second mini-derricks 332 and 334 on a base 336 are movable down within the derrick 340 by movement apparatus 360 (shown schematically; may be any movement apparatus disclosed herein for moving a crown assembly). FIG. 10C shows the position—in dotted line—of the mini-derricks once lowered within the derrick 340.

Other apparatus, equipment, and structure in the rig 340 which is not labeled or named is as in, e.g., U.S. Pat. No. 6,068,069.

It is within the scope of the present invention to provide a derrick of any suitable height for a vessel or a drill ship, to provide a crown block assembly of any suitable height, and to provide structure and apparatuses for moving the crown block assembly or a crown block assembly and some support structure up and down to achieve a derrick height and/or a desired relocation of a vessel's or a ship's center of gravity.

The present invention, therefore, provides in some, but not in necessarily all, embodiments a vessel or a drill ship with a selectively adjustable height and/or an adjustable center of gravity and a crown block assembly movably mounted in a derrick of the ship.

The present invention, therefore, provides in some, but not in necessarily all, embodiments a system for well operations, the system comprising a floating system, the system having: a hull; a deck on the hull; a derrick on the deck, the derrick having a top and a top portion; a crown assembly on the derrick; the crown assembly movably mounted to the derrick for movement with respect to the top portion of the derrick to reduce overall height of the derrick. Such a system may one or some, in any possible combination, of the following: the system is one of a vessel, drill ship, semi-submersible rig, floating jack-up rig, and floating rig; wherein the system has a center of gravity and the crown assembly is movable to lower the center of gravity; well operation equipment connected to the derrick, the well operation equipment movable to facilitate lowering of the crown assembly past the well operation equipment; wherein the crown assembly is lowered between twenty feet and fifty feet below the top of the derrick; wherein the crown assembly is lowerable within the derrick; motion compensation apparatus connected to the crown assembly and lowerable therewith; movement apparatus connected to the crown assembly for lowering the crown assembly with respect to the derrick; wherein the movement apparatus is one of powered apparatus with reeled lines connected to the crown assembly; powered piston-cylinder apparatus; and a toothed-pillar jacking system; wherein the crown assembly is a first crown assembly, the system further having the derrick being a dual activity derrick structure, the first crown assembly connected to a lowerable with respect to the dual activity derrick structure, a second crown assembly connected to and lowerable with respect to the dual activity derrick structure, and movement apparatus for moving the crown assemblies with respect to the dual activity derrick structure; and/or the crown assembly includes a base, the base receivable within the derrick.

The present invention, therefore, provides in some, but not in necessarily all, embodiments a system for well operations, the system comprising a floating system, the system having: a hull; a deck on the hull; a derrick on the deck, the derrick having a top and a top portion; a crown assembly on the derrick; the crown assembly movably mounted to the derrick for movement with respect to the top portion of the derrick to reduce overall height of the derrick; the system one of a vessel, drill ship, semi-submersible rig, floating jack-up rig, and floating rig; wherein the system has a center of gravity and the crown assembly is movable to lower the center of gravity; wherein the crown assembly is lowered between twenty feet and fifty feet below the top of the derrick; wherein the crown assembly is lowerable within the derrick; movement apparatus connected to the crown assembly for lowering the crown assembly with respect to the derrick; and wherein the movement apparatus is one of powered apparatus with reeled lines connected to the crown assembly; powered piston-cylinder apparatus; and a toothed-pillar jacking system. Such a system may one or some, in any possible combination, of the following: the crown assembly may be a first crown assembly, and the derrick may be a dual activity derrick structure with the first crown assembly connected to and lowerable with respect to the dual activity derrick structure and a second crown assembly connected to and lowerable with respect to the dual activity derrick structure, and movement apparatus for moving the crown assemblies with respect to the dual activity derrick structure.

The present invention, therefore, provides in some, but not in necessarily all, embodiments methods for reducing derrick height of a derrick of a system for well operations, the system being a floating system, the method including: activating a movement apparatus of a system, the system as any disclosed herein; and moving a crown assembly of the system on a derrick with the movement apparatus to reduce derrick height. In such methods there may be motion compensation apparatus connected to the crown assembly, the method further including lowering the motion compensation apparatus with the crown assembly; and/or the crown assembly may include a base, the method including lowering with the movement apparatus the crown assembly and the base within the derrick.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A floating system that is adapted for performing well operations, the floating system comprising:

a hull;

a deck positioned above said hull;

a derrick positioned above said deck, wherein said derrick comprises a dual activity derrick structure;

a first movable crown block assembly that is movably mounted on said dual activity derrick structure, wherein said first movable crown block assembly is adapted to be moved relative to a top of said dual activity derrick structure so as to reduce an overall height of said derrick; and a second movable crown block assembly that is movably mounted on said dual activity derrick, wherein said second movable crown block assembly is adapted to be moved relative to a top of said dual activity derrick structure.

2. The floating system of claim 1, wherein said floating system is one of a vessel, a drill ship, a semi-submersible rig, a floating jack-up rig, and a floating rig.

3. The floating system of claim 1, wherein said floating system comprises a center of gravity, and wherein at least one of said first and second movable crown block assemblies is adapted to be moved so as to lower said center of gravity.

4. The floating system of claim 1, further comprising well operation equipment operatively coupled to said derrick, wherein said well operation equipment is adapted to be laterally moved relative to a vertical centerline of said derrick so as to facilitate said movement of at least one of said first and second movable crown block assemblies.

5. The floating system of claim 4, wherein said well operation equipment comprises a top drive system.

6. The floating system of claim 1, wherein at least a portion of at least one of said first and second movable crown block assemblies is adapted to be raised above said top of said derrick.

7. The floating system of claim 1, wherein at least a portion of at least one of said first and second movable crown block assemblies is adapted to be lowered by a distance of between approximately twenty feet and approximately fifty feet below said top of said derrick.

8. The system of claim 1, wherein at least one of said first and second movable crown block assemblies is adapted to be lowered inside of said dual activity derrick structure.

9. The floating system of claim 1, wherein at least one of said first and second movable crown block assemblies comprises a motion compensation apparatus.

10. The floating system of claim 1, further comprising movement apparatus operatively coupled to at least one of said first and second movable crown block assemblies, wherein said movement apparatus is adapted for moving said at least one of said first and second movable crown block assemblies relative to said top of said derrick.

11. The floating system of claim 10, wherein said movement apparatus comprises one of a powered apparatus comprising reeled lines, a powered piston-cylinder apparatus, and a toothed-pillar jacking system.

12. The floating system of claim 1, wherein at least one of said first and second movable crown block assemblies is adapted to be moved during transportation of said floating system to a well site.

13. The floating system of claim 1, wherein at least one of said first and second movable crown block assemblies is adapted to be moved from a first position to a second position prior to performing well operations.

14. The floating system of claim 1, wherein at least one of said first and second movable crown block assemblies comprises a base, and said derrick is adapted to receive at least said base during said movement of said at least one of said first and second movable crown block assemblies.

15. The floating system of claim 1, further comprising a movable crown base and a movement apparatus operatively coupled to said movable crown base, wherein said first and second movable crown block assemblies are mounted on said movable crown base, and wherein said movement apparatus is adapted to move said movable crown base relative to said top of said dual activity derrick structure so as to reduce an overall height of said dual activity derrick structure.

16. A floating system that is adapted for performing well operations, the floating system comprising:

a hull;

a deck positioned above said hull;

a derrick positioned above said deck, said derrick comprising a dual activity derrick structure;

a first movable crown block assembly that is movably mounted on said dual activity derrick structure, wherein said first movable crown block assembly is adapted to be moved relative to a top of said dual activity derrick structure so as to reduce an overall height of said derrick, said first movable crown block assembly being further adapted to be lowered inside of said dual activity derrick structure by a distance of up to approximately fifty feet below said top so as to lower a center of gravity of said floating system;

a second movable crown block assembly that is movably mounted on said dual activity derrick structure, wherein said second movable crown block assembly is adapted to be moved relative to a top of said dual activity derrick structure; and movement apparatus operatively coupled to at least one of said first and second movable crown block assembly assemblies, wherein said movement apparatus is adapted for moving said at least one of said first and second movable crown block assemblies relative to said top of said dual activity derrick structure and comprises one of a powered apparatus comprising reeled lines, a powered piston-cylinder apparatus, and a toothed-pillar jacking system, and wherein said floating system is one of a vessel, a drill ship, a semi-submersible rig, a floating jack-up rig, and a floating rig.

17. A method for reducing an overall height of a derrick of a floating system that is adapted for performing well operations, the method comprising:

positioning said derrick above a deck of one of a vessel, a drill ship, a semi-submersible rig, a floating jack-up rig, and a floating rig, said derrick comprising a dual activity derrick structure;

movably mounting a first movable crown block assembly on said dual activity derrick structure;

movably mounting a second movable crown block assembly on said dual activity derrick structure;

operatively coupling a movement apparatus to said first movable crown block assembly, wherein said movement apparatus is adapted to move said first movable crown block assembly relative to a top of said derrick;

operatively coupling said movement apparatus to said second movable crown block assembly, wherein said movement apparatus is further adapted to move said second movable crown block assembly relative to said top of said derrick; and lowering at least one of said first and second movable crown block assemblies with said movement apparatus.

18. The method of 17, wherein at least one of said first and second movable crown block assemblies is lowered by a distance of between approximately twenty feet and approximately fifty feet.

19. The method of claim 17, wherein lowering said at least one of said first and second movable crown block assemblies comprises lowering a center of gravity of said floating system.

20. The method of claim 17, further comprising operatively coupling a top drive system to said derrick and laterally moving said top drive system relative to a centerline of said derrick prior to lowering said at least one of said first and second movable crown block assemblies.

21. The method of claim 17, further comprising mounting a motion compensation apparatus to at least one of said first and second movable crown block assemblies and lowering said motion compensation apparatus with said at least one of said first and second movable crown block assemblies.

22. The method of claim 17, wherein lowering said at least one of said first and second crown block assemblies comprises lowering a base of said at least one of said first and second movable crown block assemblies inside of said dual activity derrick structure.

* * * * *

UNITED STATES PATENT AND TRADEMARK OFFICE

CERTIFICATE OF CORRECTION

PATENT NO. : 8,256,520 B2
APPLICATION NO. : 12/321010
DATED : September 4, 2012
INVENTOR(S) : Alan Randall Lucas et al.

It is certified that error appears in the above-identified patent and that said Letters Patent is hereby corrected as shown below:

Col. 11, line 2, delete “assembly”.

Col. 12, line 6 (claim 18, line 1), before “17” insert -- claim --.

Signed and Sealed this
Thirteenth Day of November, 2012

David J. Kappos

David J. Kappos
*Director of the United States Patent and Trademark Office*